US006560865B2

(12) United States Patent
Wang

(10) Patent No.: US 6,560,865 B2
(45) Date of Patent: May 13, 2003

(54) ARRANGEMENT APPARATUS FOR MULTI-CORE ROUND CABLE AND METHOD FOR USING SAME

(75) Inventor: Wenli Wang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 50 days.

(21) Appl. No.: 09/844,551

(22) Filed: Apr. 27, 2001

(65) Prior Publication Data

US 2002/0083587 A1 Jul. 4, 2002

(30) Foreign Application Priority Data

Dec. 30, 2000 (TW) ..... 89128442 A

(51) Int. Cl.[7] ..... H01R 43/00

(52) U.S. Cl. ..... 29/868; 29/869; 29/884; 29/857; 174/97

(58) Field of Search ..... 439/719; 174/97; 29/857, 884, 868, 869

(56) References Cited

U.S. PATENT DOCUMENTS 4,160,575 A * 7/1979 Schraut ..... 339/103 M
4,219,913 A * 9/1980 Johnson, Jr. ..... 29/33
4,576,662 A * 3/1986 Lemke ..... 156/52
5,067,399 A * 11/1991 Berry ..... 101/11
5,727,962 A * 3/1998 Caveney et al. ..... 439/344
5,996,224 A * 12/1999 Sullivan ..... 29/863

* cited by examiner

*Primary Examiner*—Ira S. Lazarus
*Assistant Examiner*—Tu Cam Nguyen
(74) *Attorney, Agent, or Firm*—Wei Te Chung

(57) ABSTRACT

An arrangement apparatus comprises a base (10) and an elongated arranging member (12) mounted thereon, wherein the arranging member includes a plurality of channels (123) and a plurality of reference wires (1253) with predetermined colors. The reference wires are arranged in a sequence that corresponds to the arrangement of pins of a connector to be connected with the multi-core round cable. Each reference wire is disposed in alignment with a corresponding channel. The color of each reference wire is the same as the color of a core (21) of the multi-core round cable to be placed in the channel corresponding to that reference wire. An operator can freely pick up any one core and place it in the correct channel simply by matching the color of the reference wire with the color of the selected wire.

9 Claims, 5 Drawing Sheets

ARRANGEMENT APPARATUS FOR MULTI-CORE ROUND CABLE AND METHOD FOR USING SAME

BACKGROUND OF THE INVENTION

1. Field of the Invention

This invention relates to an arrangement apparatus for a multi-core round cable, and a method for using the arrangement apparatus to arrange a multi-core round cable.

2. Description of the Related Art

Round cables are commonly used in many fields for connecting and communicating two distant electrical devices. To achieve this, a cable end connector is connected with the cable. The connector is electrically connected with a complementary connector in a corresponding electrical device. To correctly connect the cable which has a large number of conductive cores therein with the connector in accordance with a predetermined specification, the cores have insulator of different colors therearound. The cores are put into a conventional arrangement apparatus according to the following sequence. The operator firstly picks up a core corresponding to a first pin of the connector, and puts it into a first channel of the apparatus. Then a second core corresponding to a second pin is put into a second channel, and so on. Finally, a color comparison member is used to check whether the cores are correctly arranged in the predetermined sequence. U.S. Pat. No. 5,996,224 shows a color comparison member 80 adapted to be used with a conventional arranging apparatus.

The above system requires the operator to sequentially select the cores according to the sequence of the pins of the connector Each time the operator needs to select the appropriate core, the operator must find such core in a randomly mixed bundle of cores. This is unduly inconvenient and time-consuming.

Hence an improved system which overcomes the deficiencies of the related art is desired.

SUMMARY OF THE INVENTION

An object of the present invention is to provide an arrangement apparatus for a multi-core round cable, which allowssimple and quick arrangement of cores of the cable into a predetermined pattern.

A further object of the present invention is to provide a method for using the arrangement apparatus to arrange a multi-core round cable.

To achieve the above objects, the present invention provides an arrangement apparatus for a multi-core round cable. The arrangement apparatus comprises a base and an elongated arranging member mounted thereon. The arranging member includes a plurality of channels and color comparison samples located beside the channels The color comparison samples consist of a series of reference wires each having an insulator with a designated color therearound. The reference wires are arranged in a sequence that corresponds to the arrangement of pins of a connector to be connected with the multi-core round cable. Each reference wire is disposed in alignment with a corresponding channel. The color of each reference wire is the same as the color of the core of the multi-core round cable to be placed in the channel corresponding to that reference wire. An operator can freely pick up any one core and place it in the correct channel simply by matching the color of the reference wire with the color of the selected wire. Similarly, all other cores are placed in the correct channels by repeating the above operation. As a consequence, arrangement of the cores is more convenient and faster.

DESCRIPTION OF PREFERRED EMBODIMENT OF THE INVENTION

Figure 1:
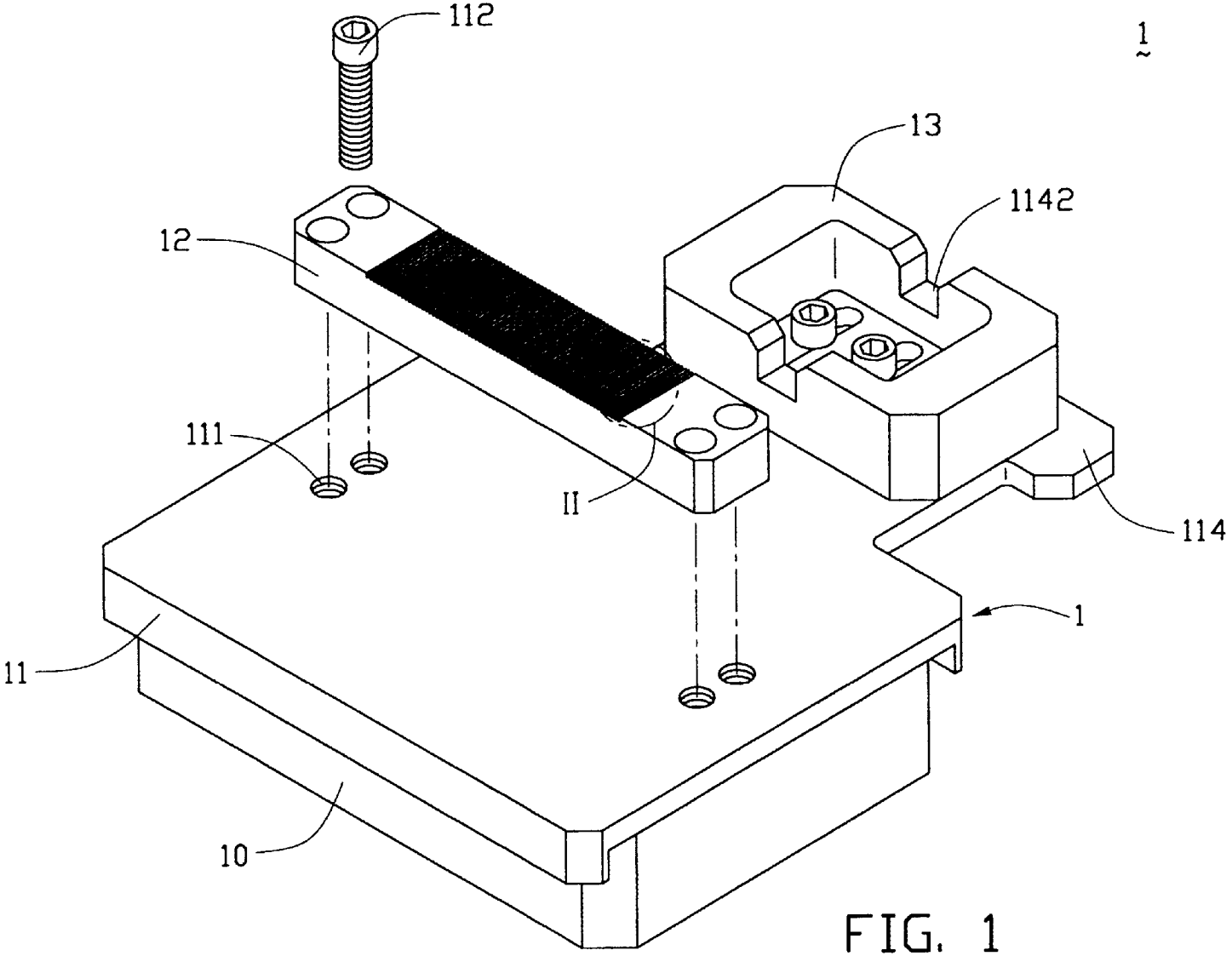
FIG. 1 is an exploded perspective view of an arrangement apparatus in accordance with the present invention.

As shown in FIG. 1, an arrangement apparatus 1 in accordance with the present invention comprises a base 10, a table 11 integrally formed on the base 10, an elongated arranging member 12 and a rest block 13.

The table 11 has four screw holes 111 defined therein, for respectively receiving four screws 112 (only one shown). The table 11 also comprises a horizontal grasping portion 114 extending from a rear edge thereof, for supporting the rest block 13. The rest block 13 has a pair of aligned cutouts 1142 defined in a central portion thereof. The cutouts 1142 are aligned perpendicular to the arranging member 12.

Figure 2:
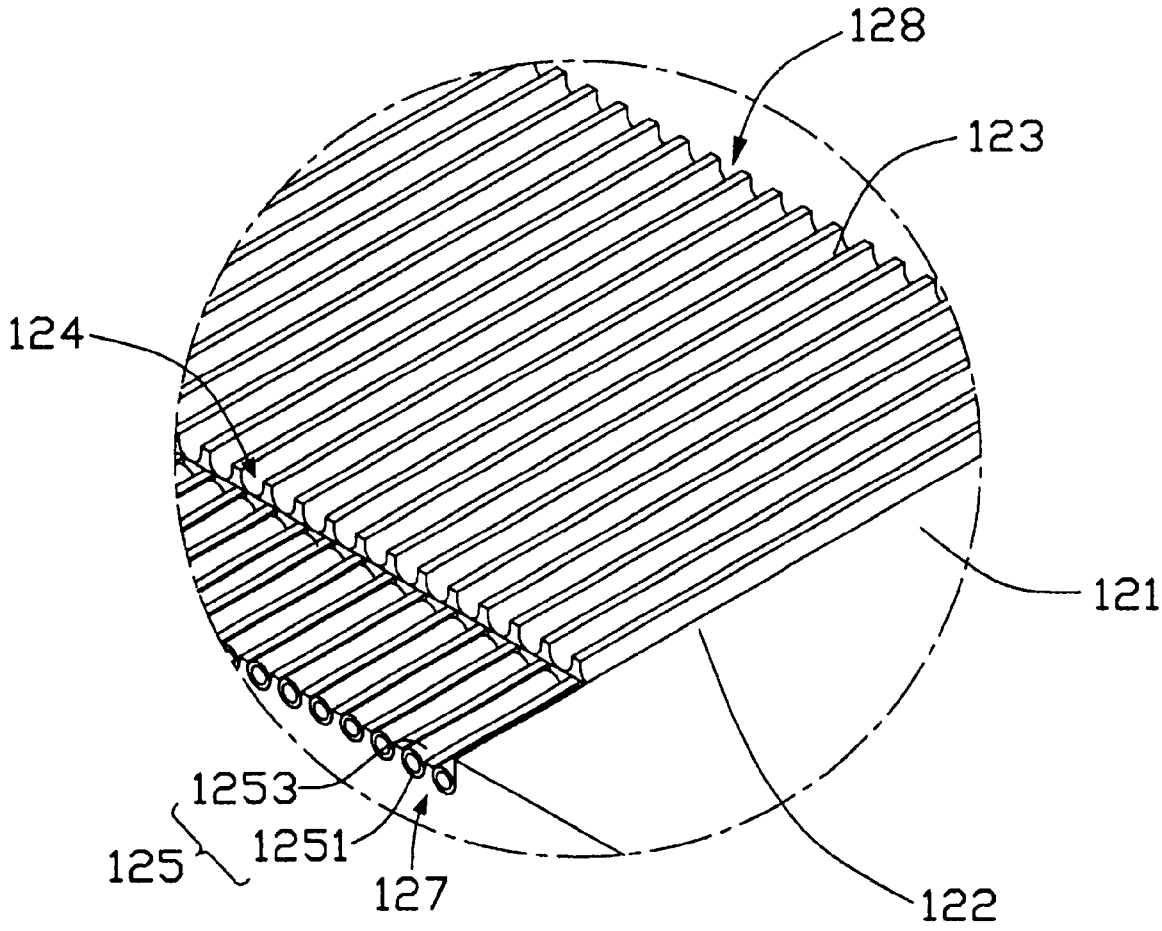
FIG. 2 is an enlarged view of a portion of FIG. 1 indicated by a circle II.
Figure 3:
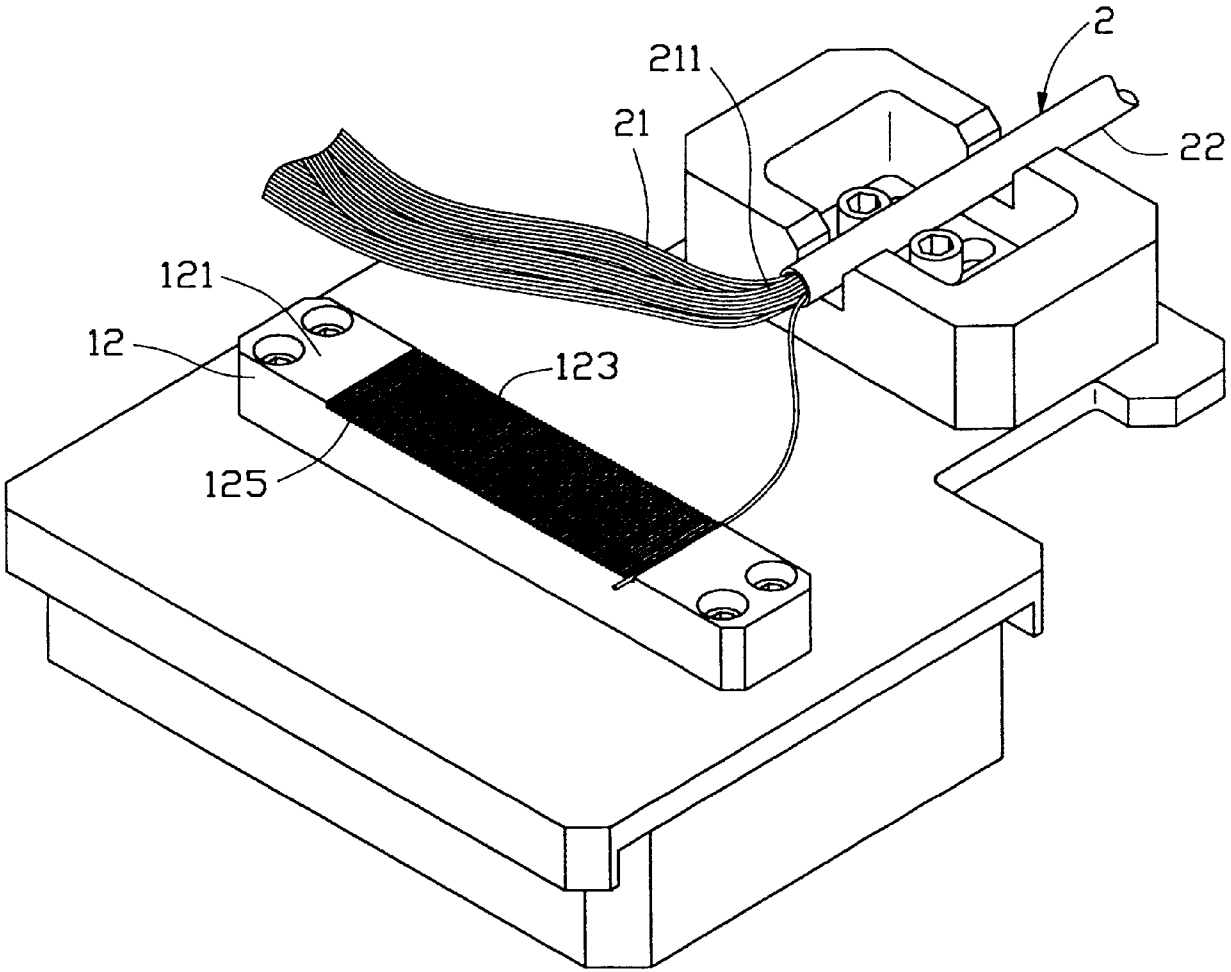
FIG. 3 is an assembled perspective view of the apparatus of FIG. 1, together with a core of a multi-core round cable placed in a channel of the apparatus.

As shown in FIGS. 2 and 3, the arranging member 12 comprises a body 121 and two pairs of through holes (not labeled) at respective opposite ends of the body 121. The body 121 has a plurality of channels 123 and color comparison samples 125. A step 124 is formed at a middle portion 122 of a top surface of the arranging member 12, thereby dividing the middle portion 122 into a front lower section 127 and a rear higher section 128. The channels 123 are defined in the rear higher section 128, and the color comparison samples 125 are disposed at the front lower section 127. The color comparison samples 125 comprise a plurality of passages 1251 each corresponding to one channel 123, and a plurality of reference wires 1253 each disposed in one corresponding passage 1251. Each reference wire 1253 has a designated color which corresponds to a pin of a connector (not shown). Each reference wire 1253 has a different color from that of all other reference wires 1253.

Figure 4:
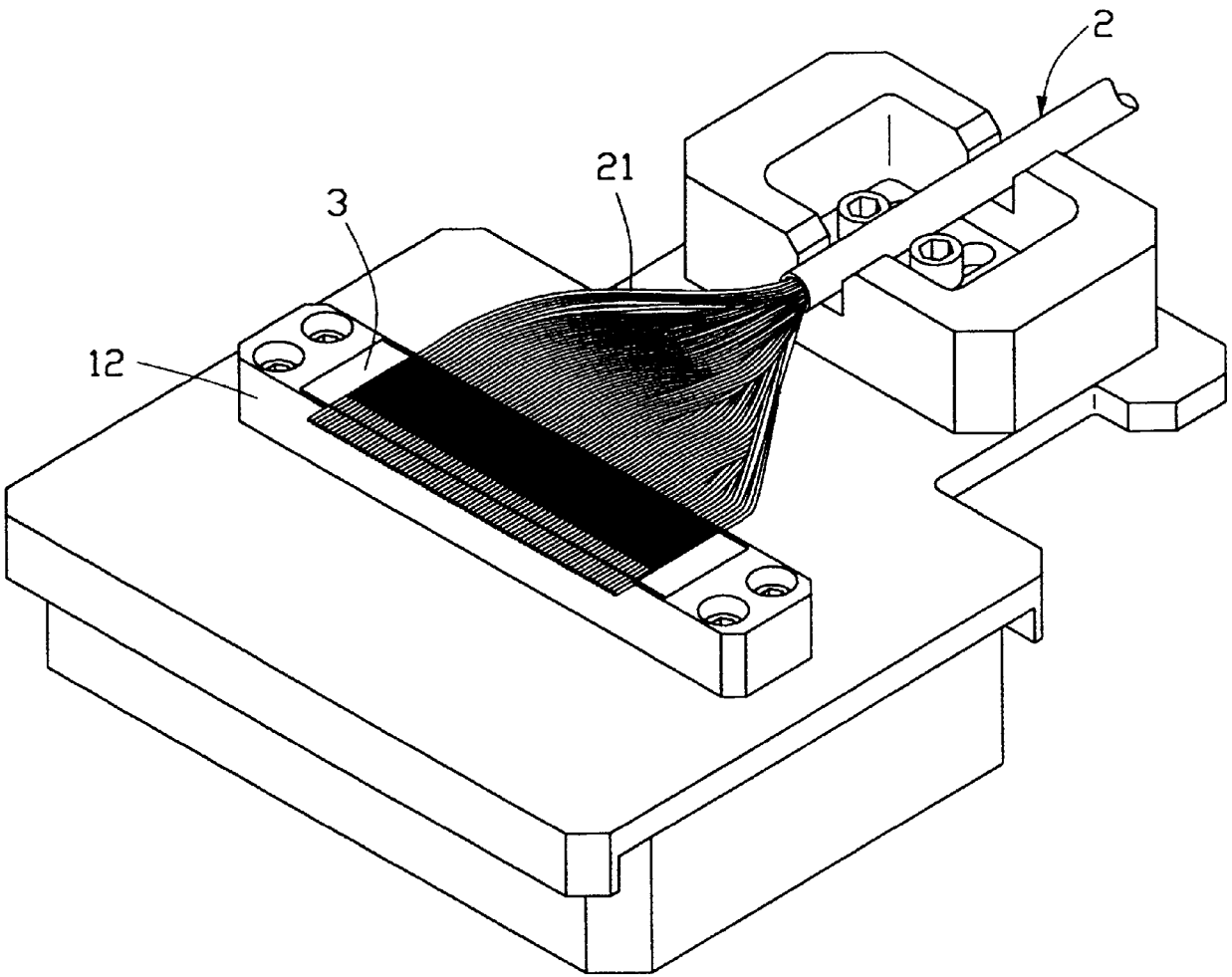
FIG. 4 is similar to FIG. 3, but showing all cores of the cable placed in the channels of the apparatus, and also a melting layer placed on upper surfaces of the cores.
Figure 5:
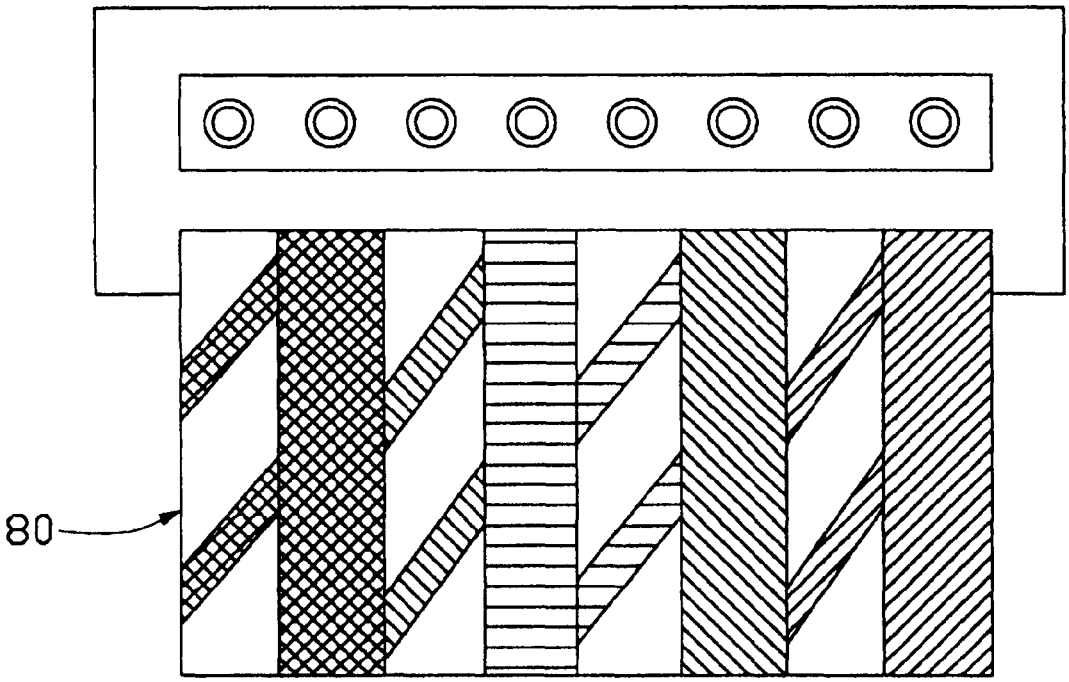
FIG. 5 (RELATED ART)
FIG. 5 is a planar view of a conventional color comparison member used for checking the correctness of arrangement of cores of a multi-core round cable.

As shown in FIG. 3, a multi-core round cable 2 has a plurality of cores 21 and a jacket 22. Each core 21 comprises an insulator 211 having a designated color. The colors of the insulators 211 correspond to the colors of the reference wires 1253. As shown in FIG. 4, a melting layer 3 is used to bind the core wires 21 together.

In assembly, the screws 112 are inserted through the through holes (not labeled) of the arranging member 12 to engage in the screw holes 111 of the table 11, thereby fastening the arranging member 12 to a top surface of the table 11. The rest block 13 is mounted on the grasping portion 114 of the table 11.

In use, the multi-core round cable 2 is put in the cutouts 1142 of the rest block 13. Part of the jacket 22 is stripped from the multi-core round cable 2, such that a desired uniform length of all cores 21 is exposed proximate the arranging member 12. One core 21 is randomly picked up from the cores 21. The color of the selected core 21 is compared with the colors of the reference wires 1253 of the color comparison sample 125. The selected core 21 is then placed in the channel 123 which corresponds to that reference wire 1253 having the same color as the selected core wire 21.

As shown in FIG. 4, all the cores 21 of the multi-core round cable 2 are placed in appropriate corresponding channels 123 by repeating the operation described above. The melting layer 3 is fixed to upper surfaces of the cores 21 located in the channels 123. Thus, all the cores 21 are bound together as a single flat unit.

Unlike related art systems, the present invention does not require an operator to select each core of the multi-core round cable according to a predetermined sequence. Rather, in the instant invention each randomly selected core is inserted into the corresponding available/vacant channel in compliance with the reference wire/symbol aside. In this presently preferred embodiment, the aligned, same colored reference wires/symbols with regard to the channels, facilitate locating the randomly selected cores into the correct channels, respectively. As a consequence, arrangement of the cores is more convenient and faster. Understandably, the distal ends of the reference wires may be staggered with one another for easy identification. Also, the reference wires may be replaced by the color strips for the same identification purpose.

Although described in the context of a particular embodiment, it will be realized that a number of modifications to these teachings may be made by one skilled in the art. Thus, while the invention has been particularly shown and described with respect to a specific embodiment thereof, it will be understood by those skilled in the art that changes in form and shape may be made thereto without departing from the scope and spirit of the invention as expressed in the appended claims.

What is claimed is:

1. An arrangement apparatus for arranging cores of a multi-core round cable into a predetermined sequence, the cores each having a predetermined color, the arrangement apparatus comprising:

a base;

an arranging member attached to an upper surface of the base, the arranging member comprising a plurality of channels for receiving the cores of the multi-core round cable and a plurality of color comparison samples fixed on the arranging member, each color comparison sample comprising a reference wire, each reference wire being located in alignment with one corresponding channel and having a color which is the same as one predetermined color of one core to be located in the corresponding channel.

2. The arrangement apparatus according to claim 1, wherein the reference wires are arranged in a predetermined sequence.

3. The arrangement apparatus according to claim 1, wherein the arranging member comprises a step formed at a middle portion of a top surface of the arranging member thereby dividing the middle portion into a lower section and a higher section, the color comparison samples being disposed in the lower section and the channels being defined in the higher section.

4. The arrangement apparatus of claim 1, further comprising a grasping portion extending from one edge of the base, and a rest block supported by the grasping portion, at least one cutout being defined in the rest block.

5. A method for arranging cores of a multi-core round cable, comprising at least the steps of:

preparing a multi-core round cable and a multi-core round cable arranging apparatus, the cable comprising a plurality of cores, each core including an insulator having a predetermined color, the arranging apparatus comprising a plurality of channels in a rear portion thereof and a plurality of reference wires fixed on a front portion thereof and in alignment with the corresponding channels, respectively, a color of each of said reference wires having a same color with each of said cores which is adapted to be placed in the corresponding channel;

arranging the cores, wherein one of the cores is randomly selected, a color of the selected core is compared with the colors of the wire-Positioning signs, the selected core is placed in the corresponding channel, and all other cores are placed in corresponding channels by repeating the arranging.

6. The method of claim 5, wherein the referenced wires are placed in passages in alignment with the channels, respectively, and wherein the passages are located at a level which is lower than that at which the channels are located.

7. An apparatus for arranging cores of a round cable into a flat configuration in accordance with a predetermined specification, the cores each having a colored-insulation therearound, comprising:

a body having a top face defining a first Section and a second section, the first section defining a plurality of channels for receiving the cores of the cable, respectively, and a plurality of reference wires being fixed on the second section for comparing the color of the core received in a corresponding channel to determine whether the core is placed in the channel in accordance with the predetermined specification.

8. The apparatus of claim 7, wherein a step is formed on the top face of the body and divides the top face into an upper section and a lower section, the upper section constituting the first section and the lower section constituting the second section.

9. An intermediate assembly comprising:

an apparatus including an arranging member with first and second sections along a front-to-back direction thereof;

a plurality of channels defined in said first section along said front-to-back direction;

a plurality of reference wires having different colors thereof and fixedly disposed on the second section respectively in alignment with the corresponding channels along said front-to-back direction; and a plurality of cores of a round cable respectively received within the corresponding channels; wherein the reference wires and the cores aligned therewith along said front-to-back direction, have the same colors, respectively; wherein some cores share the same colors with others, respectively.

* * * * *